US006511122B1

(12) United States Patent
Chen

(10) Patent No.: US 6,511,122 B1
(45) Date of Patent: Jan. 28, 2003

(54) FOLDABLE CHAIR HAVING A REDUCED STORAGE SPACE IN A FOLDED STATE AND ADJUSTABLE BACKREST INCLINATION

(76) Inventor: Jarn-Chun Chen, 4F., 203 Ho-Ping E. Road, Sec. 2, Taipei (TW), 106

( * ) Notice: Subject to any disclaimer, the term of this patent is extended or adjusted under 35 U.S.C. 154(b) by 0 days.

(21) Appl. No.: 09/915,377

(22) Filed: Jul. 27, 2001

(51) Int. Cl.[7] ..... A47C 4/00
(52) U.S. Cl. ..... 297/16.2; 297/38; 297/39
(58) Field of Search ..... 297/16.2, 16.1, 297/38, 39

(56) References Cited

U.S. PATENT DOCUMENTS 2,709,481 A * 5/1955 Budai ..... 297/38
5,294,171 A * 3/1994 Horng ..... 297/38
6,030,032 A * 2/2000 Tseng ..... 297/38
6,213,545 B1 * 4/2001 Chun-Yuch ..... 297/39
6,217,111 B1 * 4/2001 Tseng ..... 297/39

* cited by examiner

*Primary Examiner*—Rodney B. White
(74) *Attorney, Agent, or Firm*—Bacon & Thomas, PLLC

(57) ABSTRACT

A foldable chair includes a backrest, a seat member, a pair of elongated armrests, a pair of front legs and rear legs, and a pair of connecting members. The seat member has a rear end connected pivotally to a lower end of the backrest. The front leg has an upper end mounted pivotally to the armrest, and an intermediate portion connected pivotally to the seat member. The rear leg has an upper end pivotally connected to the armrest when the chair is in use or is slidably received in the armrest when folded. The connecting member has a first end mounted pivotally on the lower end of the backrest, and a second end mounted pivotally on an intermediate portion of the rear leg, so that the lower ends of the front legs are close to the lower ends of the rear legs when the chair is folded.

6 Claims, 5 Drawing Sheets

FOLDABLE CHAIR HAVING A REDUCED STORAGE SPACE IN A FOLDED STATE AND ADJUSTABLE BACKREST INCLINATION

BACKGROUND OF THE INVENTION

1. Field of the Invention

The invention relates to a foldable chair, and more particularly to a foldable chair which has a adjustable backrest inclination when it is in use, and occupies a relatively smaller storage space when folded.

2. Description of the Related Art

FIG. 1 illustrates a conventional foldable chair 1 which includes a seat member 2, a backrest 3. a pair of elongated armrests 13 (only one is visible), a pair of front legs 11 (only one is visible), and a pair of rear legs 12 (only one is visible). The backrest 3 has a lower end connected pivotally to a rear end portion of the seat member 2 by means of a pair of connecting plates 20 disposed on lateral sides of the foldable chair 1 and by means of pivot pins 201, 202 that extend through the connecting plates 20 such that the seat member 2 is foldable toward and away from the backrest 3. The armrests 13 have rear ends extending respectively to lateral sides of the backrest 3 above the connecting plates 20 and connected pivotally to the backrest 3 by means of pivot pins 133 The front and rear legs 11, 12 are disposed respectively on lateral sides of the seat member 2. Each of the front legs 11 has an upper end connected pivotally to a front end of a respective one of the armrests 13 by means of a pivot pin 131, a lower end to be supported on a ground surface, and an intermediate portion connected pivotally to the seat member 2 by means of a pivot pin 21. Each of the rear legs 12 is disposed rearwardly of a respective one of the front legs 11, and has an upper end connected pivotally to an intermediate portion of a respective one of the armrests 13 by means of a pivot pin 132, a lower end to be supported on the ground surface, and an intermediate portion connected to an adjacent one of the connecting plates 20 by means of a pivot pin 22. Referring to FIG. 2, to fold the foldable chair 1, the seat member 2 and the armrests 13 are turned rearwardly toward the backrest 3. After the foldable chair 1 is folded, the seat member 2 is folded on and is disposed in front of the backrest 3, the armrests 13 are disposed respectively on the lateral sides of the backrest 3, and the front legs 11 are disposed respectively in front of and adjacent to the rear legs 12. The foldable chair 1, in its folded state, has a thickness which is measured between front and rear sides of the foldable chair 1 In the folded state and which is generally equal to the combined thickness of the backrest 3 and an adjacent pair of the first and second legs 11, 12. It is desirable to further reduce the thickness of the chair assembly in its folded state so as to reduce the storage space occupied thereby.

U.S. Pat No. 6,217,111 discloses a foldable chair assembly including a backrest member, a seat member pivoted to the backrest member, two elongated armrest members with rear ends pivoted to the backrest member, two front leg members and two rear leg members. Each armrest member has a first portion proximate to a lateral side of the seat member, and a second portion distal to the lateral side of the seat member. Each front leg member has an upper end pivoted to the first portion of a respective armrest member, a lower end, and an intermediate portion pivoted to the seat member. Each rear leg member has an upper end pivoted to the second portion of a respective armrest member, a lower end, and an intermediate portion pivoted to the backrest member. When the chair assembly is in a folded state, the backrest member, the seat member, the armrest members and the front and rear leg members are substantially upright, and the front leg members are disposed between the rear leg members and are generally parallel to the rear leg members, so as to reduce the thickness of the chair assembly, thereby reducing the storage space, U.S. Pat. No. 6,213,545 discloses an improved foldable chair having a construction similar to U.S. Pat. No. 6,217,111.

There is still a great need in the industry to look for a foldable chair having a further reduced storage space in a folded state. It is advantageous if the foldable chair further has an adjustable backrest inclination.

SUMMARY OF THE INVENTION

An primary object of the present invention is to provide a foldable chair which has a significantly reduced height in its folded state such that the fold chair occupies a relatively smaller storage space when it is folded. Advantageously, the foldable chair further has an adjustable backrest inclination.

In order to accomplish this object, a foldable chair constructed according to the present invention includes a backrest, a seat member, a pair of elongated armrests, a pair of front legs, a pair of rear legs, and a pair of a first connecting members. The backrest has a lower end, an upper end, and an intermediate portion between the upper and lower ends. The seat member has a rear end portion connected pivotally to the lower end of the backrest, preferably by a pair of a second connecting members, and a front end portion extending forwardly from the rear end portion. The armrests are disposed respectively on two opposite lateral sides of the seat member. Each of the armrests has a rear end which extends to a respective one of the two opposite lateral sides of the backrest and which is connected pivotally to the intermediate portion of the backrest. The front legs are disposed respectively at the lateral sides of the seat member. Each of the front legs has an upper end mounted pivotally to a front end of a respective one of the armrests, a lower end which is adapted to be disposed on a ground surface, and an intermediate portion extending between the upper and lower ends and connected pivotally to the front end portion of the seat member. The rear legs are disposed respectively at the lateral sides of the seat member, and are disposed rearwardly of the front legs, respectively. Each of the rear legs has an upper end adjustably mounted on an intermediate portion of a respective one of the armrests, a lower end adapted to be disposed on the ground surface, and an intermediate portion extending between the upper and lower ends of the rear leg. Each of the first connecting members has a first end mounted pivotally on the lower end of the backrest or the rear end portion of the seat member, and a second end mounted pivotally on the intermediate portion of a respective one of the rear legs. The foldable chair is movable between an unfolded state, in which the backrest and the front and rear legs are substantially upright, and the seat member and the armrest s are substantially horizontal, and a folded state, in which the backrest, the seat member, the armrests and the front and rear legs are substantially upright. The upper end of the rear leg is pivotally connected to the armrest when the foldable chair is in the unfolded state and is slidably received in the armrest when the foldable chair is in the folded state. The first end and the second end of each of the first connecting members are spaced apart with such a distance so that the lower ends of the front legs are close to the lower ends of the rear legs when the foldable chair is in the folded state.

Preferably, the intermediate portion of each of the armrests has a pair of retaining grooves, each of which includes a slide groove portion extending in the longitudinal direction of the armrest and between the front end of the armrest and a point spaced apart from the rear end of the armrest, The upper end of each of the rear legs is provided with a shaft having two opposite ends which extend respectively into said pair of retaining grooves and which are slidable along said slide groove portions and extendible into a confronting pair of said engaging groove portions for engaging the confronting pair of said engaging groove portions Preferably the upper end of the front leg mounted on the armrest and the upper end of the rear leg received in the same armrest are spaced apart in a transverse direction traverse to the longitudinal direction of the armrest with the former closer to the lateral side of the seat member in comparison with the latter.

Preferably the first connecting member and the second connecting member are formed into an integral member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
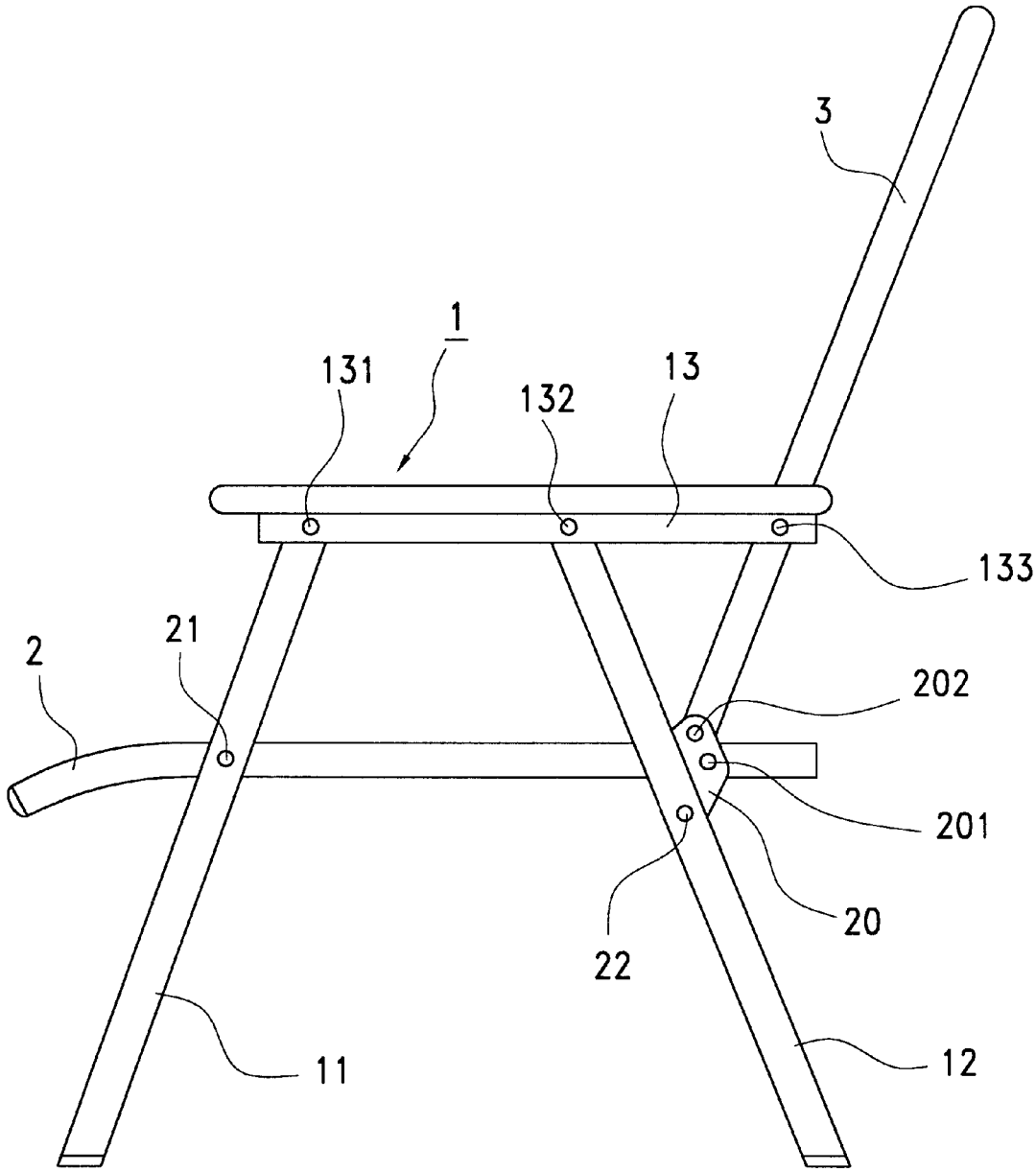
FIG.1 PRIOR ART
FIG. 1 is a side view of a conventional foldable chair in an unfolded state.
Figure 2:
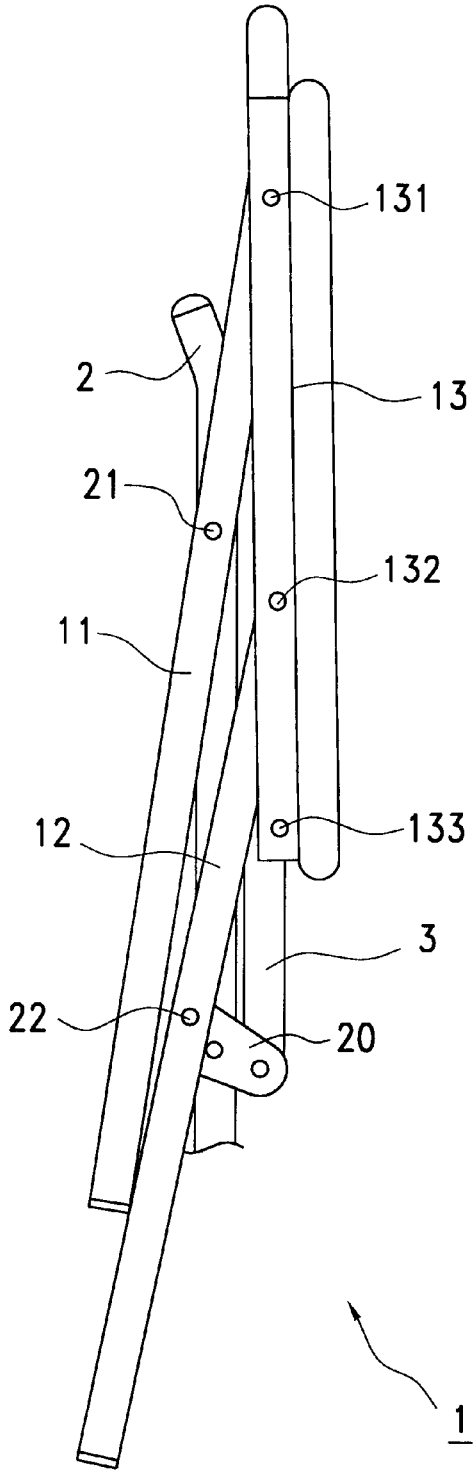
FIG.2 PRIOR ART
FIG. 2 is a side view of the conventional foldable chair in a folded state.
Figure 3:
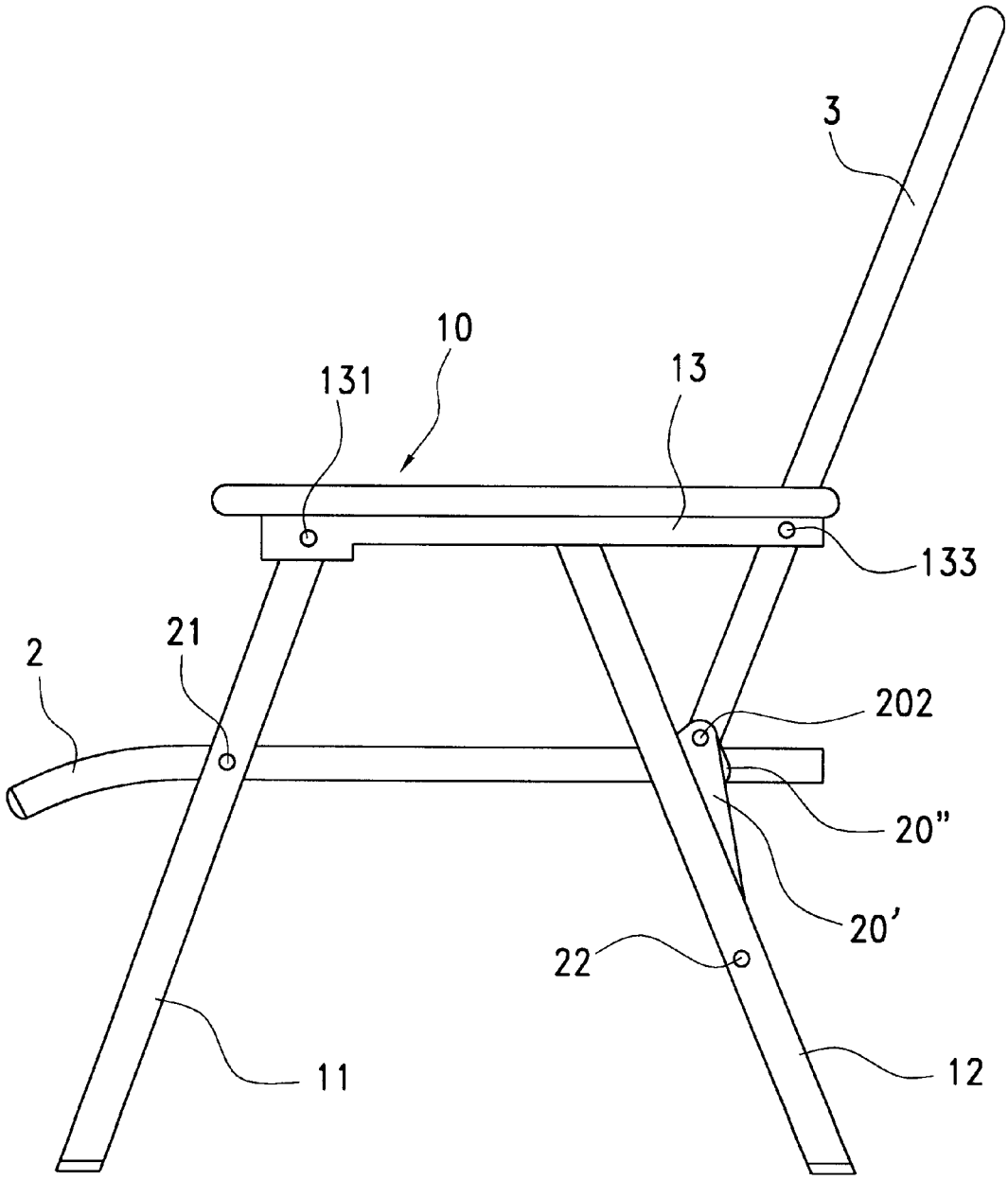
FIG. 3 is a side view of a first preferred embodiment of the foldable chair of the present invention in an unfolded state.
Figure 4:
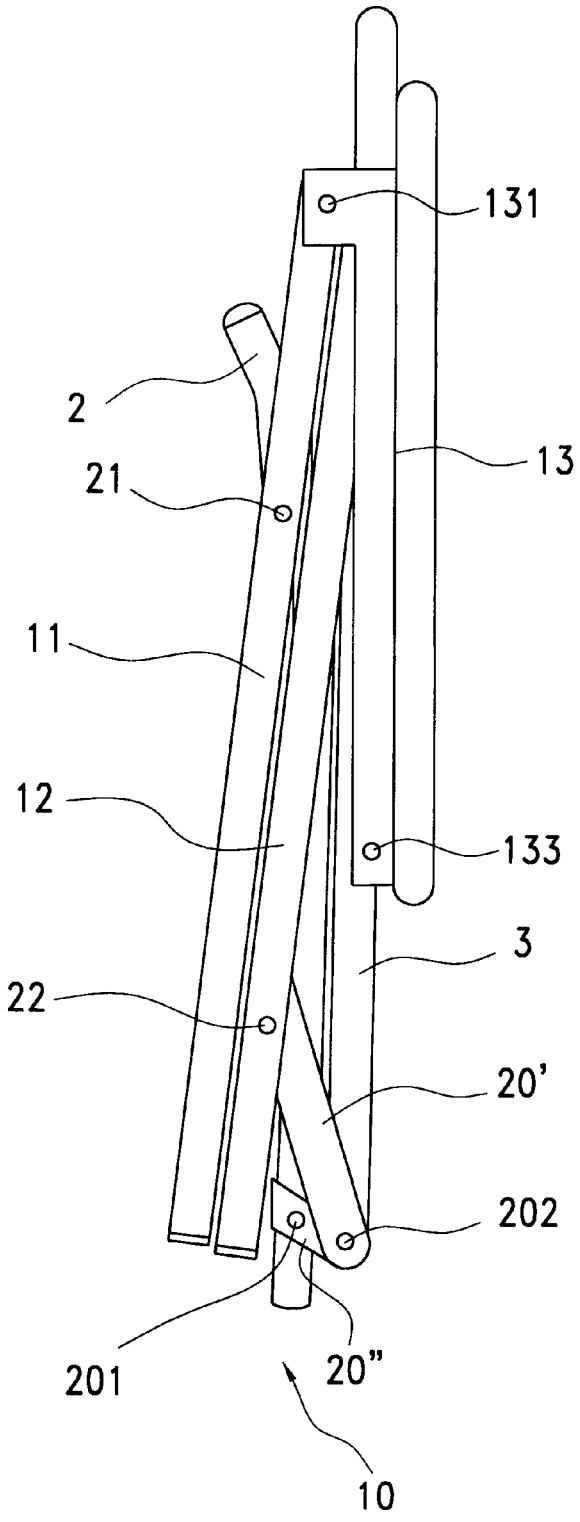
FIG. 4 is a side view of the first preferred embodiment in a folded state.

A foldable chair 10 constructed according to one of the preferred embodiments of the present invention is shown in FIGS. 3 and 4. in which parts or members similar to those shown in FIGS. 1 and 2 utilize common identification numbers. Referring to FIGS. 3 and 4, the foldable chair 10 of the present invention is shown to include a seat member 2, a backrest 3, a parallel pair of front legs 11, a parallel pair of rear legs 12, a pair of elongated armrests 13, a pair of connecting plates 20' and a pair of pivot connectors 20".

The backrest 3 has an upper end, a lower end and an intermediate portion extending between the upper and lower ends. The seat member 2 has a rear end portion connected pivotally to the lower end of the backrest 3 by means of said pair of pivot connectors 20" and by means of pivot pins 201, 202 that extend through the pivot connectors 20" such that the seat member 2 is foldable toward and away from the backrest 3.

The front legs 11 are disposed respectively on two opposite lateral sides of the seat member 2. Each of the front legs 11 has a lower end adapted to be disposed on a ground surface, an upper end connected pivotally to a respective one of the armrests 13, and an intermediate portion which extends between the upper and lower ends and which is connected pivotally to a front end portion of the seat member 2 by means of a pivot pin 21.

The rear legs 12 are disposed rearwardly of the front legs 11 and are disposed respectively on the lateral sides of the seat member 2. Each of the rear legs 12 has a lower end adapted to be disposed on the ground surface, an upper end adjustably connected to a respective one of the armrests 13, and an intermediate portion which extends between the upper and lower ends and which is mounted pivotally to the lower end of the backrest 3 by means of a respective one of the connecting plate 20'. Each of the connecting plates 20' has an upper end connected pivotally to the lower end of a respective one of the backrest 3 by means of the pivot pin 202, and a lower end connected pivotally to the intermediate portion of a respective one of the rear legs 12 by means of a pivot pin 22.

Figure 5:
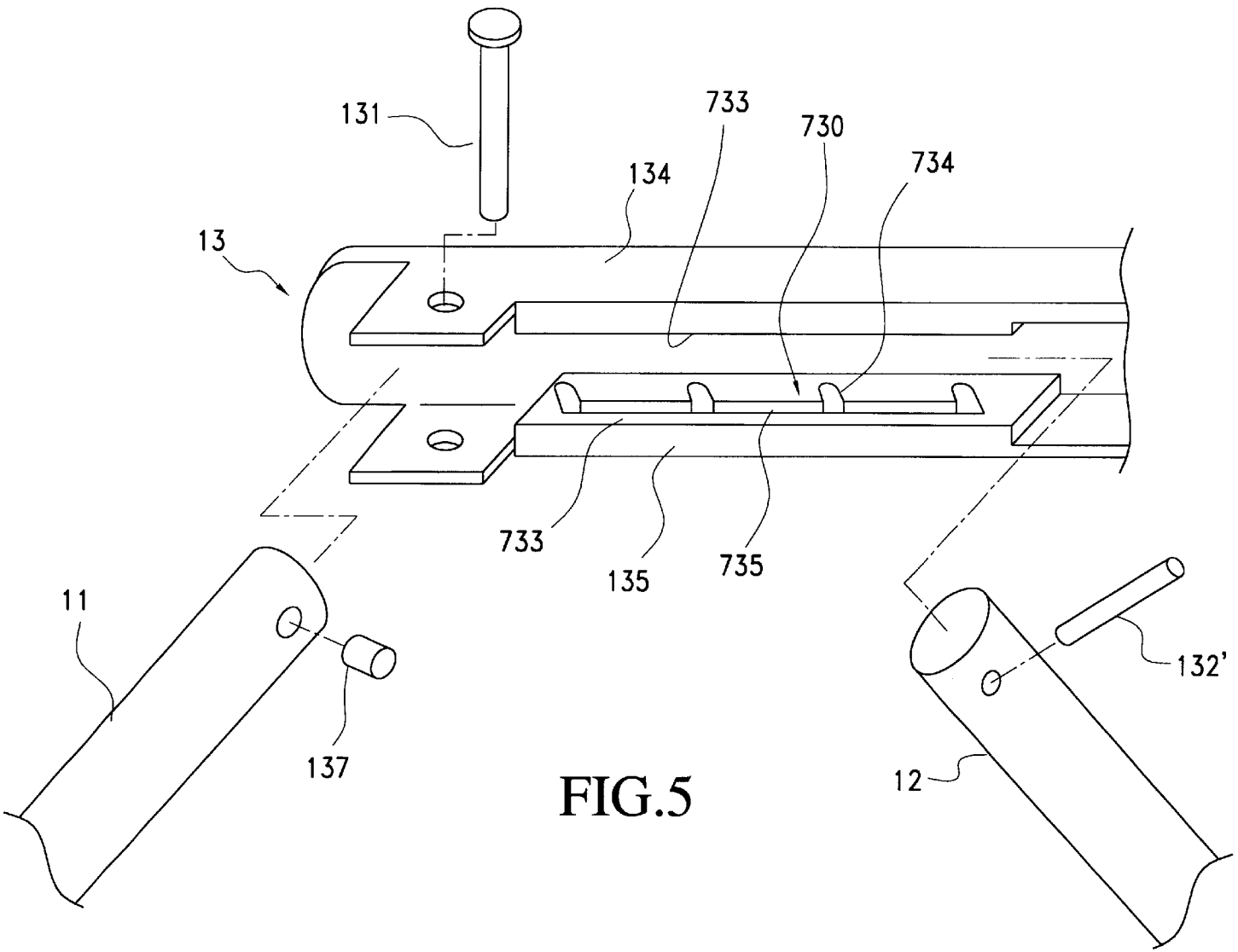
FIG. 5 is a fragmentary perspective view of the first preferred embodiment, illustrating how a front leg and a rear leg are connected to an armrest.

The armrests 13 are disposed respectively on the lateral sides of the seat member 2, and have rear ends extending respectively to two opposite lateral sides of the backrest 3 and connected pivotally to the intermediate portion of the backrest 3 by means of pivot pins 133. Referring to FIG. 5, each of the armrests 13 has a longitudinal first side wall 134 proximate to the respective one of the lateral sides of the seat member 2 and a longitudinal second sidewall 135 opposite to and spaced apart from the first side wall 134 and distal to the respective one of the lateral sides of the seat member 2 in a transverse direction transverse to a longitudinal direction of the armrest 13. The upper end of each of the front legs 11 extends to the bottom side of the respective one of the armrests 13, and is disposed proximate to the first side wall 134 by using a tubular sleeve 137. The upper end of each front leg 11 is connected pivotally to the respective armrest 13 by means of the pivot pin 131 that extends between the first and second side walls 134, 135 of the respective armrest 13 and the tubular sleeve 137.

The upper end of each of the rear legs 12 extends to the bottom side of the respective one of the armrests 13, and is disposed between thickened portions of the first and second side walls 134 and 135. Each of the thickened portions has an inner surface 733 confronting the other one of the first and second side walls 134, 135 and formed with a retaining groove 730 which includes a slide groove portion 735 that extends in the longitudinal direction of the armrest 13, and a series of engaging groove portions 734 that are communicated with the slide groove portion 735 and that extend upwardly from the slide groove portion 735. A pivot shaft 132' is received in a pair of through holes provided at the upper end of each of the rear legs 12. The pivot shaft 132' has two opposite ends which extend respectively into the retaining grooves 730 in the inner surfaces 733 of the first and second side walls 134, 135, and which are slidable along the slide groove portions 735 for extension into a selected confronting pair of the engaging groove portions 734, thereby permitting adjustment of the inclination of the backrest 3. When the foldable chair 10 is in an unfolded state, the pivot shaft 132' of each armrest 13 engages a selected pair of the engaging groove portions 734 in the armrest 13 for positioning the backrest 3 at a desired inclination.

When the foldable chair 10 is to be folded from the unfolded state in FIG. 3, the front end of the seat member 2 is pushed upward toward the backrest 3, the upper ends of the connecting plates 20' are turned downward by using the pivot pin 22 as an axis, causing the lower end of the backrest 3 together with the rear ends of the front legs moving downward while the pivot shafts 132' are disengaged with said selected pairs of the engaging groove portions 734 and are moved upward along the slide groove portions of the armrests 13. As a result, the front legs 11 are stacked on top of the rear legs 12, and the lower ends of the former are close to the lower ends of the latter as shown in FIG. 4. It can be seen form FIGS. 2 and 4, a significant reduction in the height of the foldable chair 10 of the present invention in the folded state is accomplished, thereby reducing the storage space occupied by the foldable chair 10.

It is apparent that a further reduction of the storage space occupied by the foldable chair of the present invention can be easily achieved by reducing the thickness of the foldable chair in the folded state, if the armrests of the foldable chair of the present invention have a structure similar to that disclosed in U.S. Pat. No. 6,217,111. The details of U.S. Pat. No. 6,217,111 are incorporated herein by reference. It is also apparent that the pivot connector 20" and the connecting plate 20' of the foldable chair 10 can be integrated into one member as taught in U.S. Pat. No. 6,213,545, and will not adversely affect the operations and function of the foldable chair. The details of U.S. Pat. No. 6,213,545 are incorporated herein by reference.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A foldable chair comprising:

a backrest having a lower end, an upper end, and an intermediate portion between the upper and lower ends, and lateral sides;

a seat member having a rear end portion connected pivotally to the lower end of the backrest, a front end portion extending forwardly from the rear end portion, and opposite lateral sides;

a pair of elongated armrests disposed respectively on said opposite lateral sides of the seat member, each of the armrests having a rear end which extends to a respective one of the lateral sides of the backrest and which is connected pivotally to the intermediate portion of the backrest;

a pair of front legs disposed respectively at the lateral sides of the seat member, each of the front legs having an upper end mounted pivotally to a front end of a respective one of the armrests, a lower end which is adapted to be disposed on a ground surface, and an intermediate portion extending between the upper and lower ends and connected pivotally to the front end portion of the seat member;

a pair of rear legs disposed respectively at the lateral sides of the seat member and disposed rearwardly of the front legs, respectively, each of the rear legs having an upper end adjustably mounted on an intermediate portion of a respective one of the armrests, a lower end adapted to be disposed on the ground surface, and an intermediate portion extending between the upper and lower ends of the rear leg; and a pair of a first connecting members, each of the first connecting members having a first end mounted pivotally on the lower end of the backrest or the rear end portion of the seat member, and a second end mounted pivotally on the intermediate portion of a respective one of the rear legs;

the foldable chair being movable between an unfolded state, in which the backrest and the front and rear legs are substantially upright, and the seat member and the armrests substantially horizontal, and a folded state, in which the backrest, the seat member, the armrests and the front and rear legs are substantially upright, the upper end of each of the rear legs being pivotally connected to a respective one of the armrests when the foldable chair is in the unfolded state or being slidably received in the armrest when the foldable chair Is in the folded state, wherein the first end and the second end of each of the first connecting members are spaced apart with such a distance so that the lower ends of the front legs are adjacent to the lower ends of the rear legs when the foldable chair is in the folded state.

2. The foldable chair according to claim 1 further comprising a pair of second connecting members for pivotally connecting the rear end portion said seat member to the lower end of the backrest.

3. The foldable chair according to claim 2, wherein the first connecting member and the second connecting member are formed into an Integral member.

4. The foldable chair according to claim 1, wherein the intermediate portion of each of the armrests has a pair of retaining grooves, each of which includes a slide groove portion extending in the longitudinal direction of the armrest and between the front end of the armrest and a point spaced apart from the rear end of the armrest and a series of engaging groove portions communicated with and extending upwardly from said slide groove portion, and wherein the upper end of each of the rear legs is provided with a shaft having two opposite ends which extend respectively into said pair of retaining grooves and which are slidable along said slide groove portions and extendible into a confronting pair of said engaging groove portions for engaging the confronting pair of said engaging groove portions.

5. The foldable chair according to claim 1, wherein the first end of the first connecting member is mounted pivotally on the lower end of the backrest.

6. The foldable chair according to claim 1, wherein the upper end of the front legs mounted on the armrest and the upper end of the rear leg adjustably mounted on the same armrest are spaced apart in a transverse direction traverse to the longitudinal direction of the armrest with the former closer to the lateral side of the seat member in comparison with the latter.

* * * * *